US008681011B2

(12) United States Patent
Conforti

(10) Patent No.: US 8,681,011 B2
(45) Date of Patent: Mar. 25, 2014

(54) APPARATUS AND METHOD FOR DETECTING FIRES

(76) Inventor: Fred Conforti, Lisle, IL (US)

( * ) Notice: Subject to any disclaimer, the term of this patent is extended or adjusted under 35 U.S.C. 154(b) by 98 days.

(21) Appl. No.: 13/031,503

(22) Filed: Feb. 21, 2011

(65) Prior Publication Data

US 2012/0212346 A1 Aug. 23, 2012

(51) Int. Cl.
*G08B 17/10* (2006.01)

(52) U.S. Cl.
USPC ..... 340/628; 340/577; 340/630

(58) Field of Classification Search
USPC ..... 340/630, 628, 506, 511; 702/189; 382/181, 281; 341/118
See application file for complete search history.

(56) References Cited

U.S. PATENT DOCUMENTS

| | | | | |
|---|---|---|---|---|
| 4,514,720 | A | 4/1985 | Oberstein et al. | |
| 4,785,283 | A | 11/1988 | Yuchi | |
| 5,103,096 | A | 4/1992 | Wong | |
| 5,155,468 | A | 10/1992 | Stanley et al. | |
| 5,369,397 | A | 11/1994 | Wong | |
| 5,453,749 | A | 9/1995 | Morita | |
| 5,592,147 | A | 1/1997 | Wong | |
| 5,691,704 | A | 11/1997 | Wong | |
| 5,736,928 | A | 4/1998 | Tice et al. | |
| 5,764,142 | A * | 6/1998 | Anderson et al. | 340/511 |
| 5,767,776 | A | 6/1998 | Wong | |
| 5,798,700 | A | 8/1998 | Wong | |
| 5,864,286 | A | 1/1999 | Right et al. | |
| 5,917,417 | A * | 6/1999 | Girling et al. | 340/628 |
| 5,966,077 | A * | 10/1999 | Wong | 340/630 |
| 7,412,356 | B1 | 8/2008 | Dzenitis et al. | |
| 2005/0200475 | A1 | 9/2005 | Chen | |
| 2006/0007010 | A1 * | 1/2006 | Mi et al. | 340/630 |
| 2006/0115154 | A1 * | 6/2006 | Chen | 382/181 |

(Continued)

FOREIGN PATENT DOCUMENTS

| | | |
|---|---|---|
| JP | 001237797 | 9/1989 |
| JP | 002032498 | 2/1990 |

(Continued)

OTHER PUBLICATIONS

Hans-Christian Muller, "A New Approach to Fire Detection Algorithms based on the Hidden Markov Model," published in the proceedings of the 12th International Conference on Automatic Fire Detection, which took place on Mar. 25-28, 2001, in Gaithersburg, Maryland USA.

*Primary Examiner* — Steven Lim
*Assistant Examiner* — Kaleria Knox
(74) *Attorney, Agent, or Firm* — Greer, Burns & Crain, Ltd.

(57) ABSTRACT

The present smoke detection system uses a single sensor to quickly detect both fast flaming fires and smoldering fires while further reducing nuisance and false alarms. In the present detector, the sensor is preferably an ionization sensor. Specifically, a first algorithm is used to detect flaming fires and second algorithm is used to detect smoldering fires. An alarm is sounded when either algorithm generates an alarm condition. In each embodiment, the first algorithm generates an alarm condition when a sensor output signal exceeds a first threshold. The alarm condition is generated for the second algorithm when the sensor output signal: (1) exceeds a second threshold for T time.; (2) rate of change exceeds a predetermined rate of change threshold; (3) change between time $T_n$ and time $T_{n-1}$ exceeds a predetermined change threshold; or (4) sensor signal exceeds an historic standard deviation of the signal multiplied by a predetermined constant.

13 Claims, 6 Drawing Sheets

(56) References Cited

U.S. PATENT DOCUMENTS

| | | | | |
|---|---|---|---|---|
| 2006/0267756 | A1 | 11/2006 | Kates | |
| 2006/0273896 | A1 | 12/2006 | Kates | |
| 2008/0183433 | A1 | 7/2008 | Dzenitis et al. | |
| 2010/0085199 | A1 | 4/2010 | Gonzales | |
| 2011/0018726 | A1* | 1/2011 | Gonzales | 340/628 |

FOREIGN PATENT DOCUMENTS

| | | |
|---|---|---|
| JP | 05073781 | 3/1993 |
| JP | 05242377 | 9/1993 |
| JP | 009161169 | 6/1997 |
| JP | 02008077303 | 4/2008 |
| WO | 9604625 | 7/1995 |

* cited by examiner

APPARATUS AND METHOD FOR DETECTING FIRES

BACKGROUND

The present invention relates generally to smoke detectors, and particularly to a smoke detector configured for detecting both smoldering and fast flaming fires.

Smoke detectors are traditionally designed to provide an early warning by generating a visual and/or audible alarm, while at the same time minimizing nuisance and false alarms. In many instances, techniques used for detecting fast flaming fires are inadequate for detecting smoldering fires and techniques used for detecting smoldering fires are less than desired for detecting flaming fires. In addition, techniques used for detecting both flaming and smoldering fires with one sensor type result in detector thresholds that are overly sensitive and cause excessive nuisance alarms.

Several embodiments exist in the art that are directed to detecting smoldering and fast flaming fires. For example, Wong (U.S. Pat. No. 5,369,397) discloses a smoke detector/alarm that uses a carbon dioxide ($CO_2$) sensor in conjunction with an algorithm that applies a designated one of three possible alarm thresholds depending on the rate of change of sensed $CO_2$ concentration. The smoke detector in Wong is configured for raising the threshold (more insensitive) when ambient $CO_2$ levels are high and lowering the threshold (more sensitive) when ambient $CO_2$ levels are low to avoid nuisance and false alarms. Wong (U.S. Pat. No. 5,103,096) discloses a smoke detector/alarm that uses a $CO_2$ sensor with dual channels for monitoring the rate of change of the ratio of the two channels.

Furthermore, Wong (U.S. Pat. No. 5,966,077) discloses a smoke detector/alarm that uses two sensors—a smoke detector to detect smoldering fires and a $CO_2$ detector to detect fast flaming fires. However, the technology developed by Wong has not achieved commercial success, due in part to the relatively complex technology used to generate the various alarm signals. Another example is Gonzales (US2010/0085199) where the inventor monitors the rate of change of a processed signal and if the rate of change exceeds a preset rate of change, a more sensitive alarm threshold is selected. In Gonzales, additional time is required to generate an alarm condition because of the threshold adjustment.

SUMMARY

The present smoke detector uses a single sensor to quickly detect both fast flaming fires and smoldering fires while further reducing nuisance and false alarms. In the present detector, the sensor is preferably an ionization sensor. Specifically, a first algorithm is used to detect flaming fires and a second algorithm is used to detect smoldering fires. An alarm is sounded when either algorithm generates an alarm condition. In each embodiment, the first algorithm generates an alarm condition when a sensor output signal exceeds a first threshold. The alarm condition is generated for the second algorithm when the sensor output signal: (1) exceeds a second threshold for T time; (2) exceeds a predetermined rate of change threshold over T time; (3) exceeds a predetermined change threshold between times $T_n$ and time $T_{n-1}$; or (4) exceeds a standard deviation of the signal's historical fluctuations multiplied by a predetermined constant.

More specifically, a method of detecting fires using a smoke detector having a signal processor and a sensor, includes: A. obtaining an output signal reading from the sensor; B. comparing the output signal reading to a first threshold and generating an alarm condition when the output signal reading is greater than the first threshold; C. comparing the output signal reading to a second parameter and generating the alarm condition when the output signal reading is greater than the parameter; and D. repeating steps A through C until the alarm condition is generated.

Also provided is a method of detecting fires using a smoke detector having a signal processor and a sensor, including: A. obtaining an output signal reading from the sensor; B. comparing the output signal reading to a first threshold and generating an alarm condition when the output signal reading is greater than the first threshold; C. comparing the output signal reading to a second threshold and generating the alarm condition when the output signal reading is greater than the second threshold for N readings; and D. repeating steps A through C until the alarm condition is generated.

An additional embodiment provides a smoke detector, including a sensor connected to a signal processor; and an alarm; the signal processor configured for: A. obtaining a sensor output signal reading from the sensor; B. comparing the sensor output signal reading to a first threshold and generating an alarm condition when the sensor output signal reading is greater than the first threshold; C. comparing the sensor output signal reading to a second threshold and generating the alarm condition when the sensor output signal reading is greater than the second threshold for T time; and D. repeating steps A through C until the alarm condition is generated and sending an alarm signal to the alarm when the alarm condition is generated.

Another embodiment provides a method of detecting fires using a smoke detector having a signal processor and a sensor, including A. obtaining a plurality of sensor output readings from the sensor and calculating a slope; B. comparing the slope to a reference slope and generating an alarm condition when the slope is greater than the reference slope; and C. repeating steps A through B until the alarm condition is generated.

Yet another embodiment provides a method of detecting fires using a smoke detector having a signal processor and a sensor, including: A. obtaining at least one output signal reading from the sensor and calculating a delta; B. comparing the delta to a reference delta and generating an alarm condition when the delta is greater than the reference delta; and C. repeating steps A and B until the alarm condition is generated.

Also provided is a method of detecting fires using a smoke detector having a signal processor and a sensor, including: A. calculating a standard deviation after a plurality of readings; B. comparing the output signal reading to the standard deviation multiplied by a numerical constant, and generating an alarm condition when the output signal reading is greater than the standard deviation multiplied by the constant; and C. repeating steps A through B until the alarm condition is generated.

Finally, a smoke detector system is provided, the system including a plurality of smoke detectors and at least one alarm, each alarm and smoke detector being connected to a control panel including a signal processor; and the signal processor configured for: A. obtaining a sensor output signal reading sequentially from each of the sensors; B. comparing each sensor output signal reading to a first threshold and generating an alarm condition when any sensor output signal reading is greater than the first threshold; C. comparing each sensor output signal reading to a second threshold and generating the alarm condition when any sensor output signal reading is greater than the second threshold for T time; and D.

repeating steps A through C until the alarm condition is generated and sending an alarm signal to the alarm when the alarm condition is generated.

DETAILED DESCRIPTION

Figure 1:
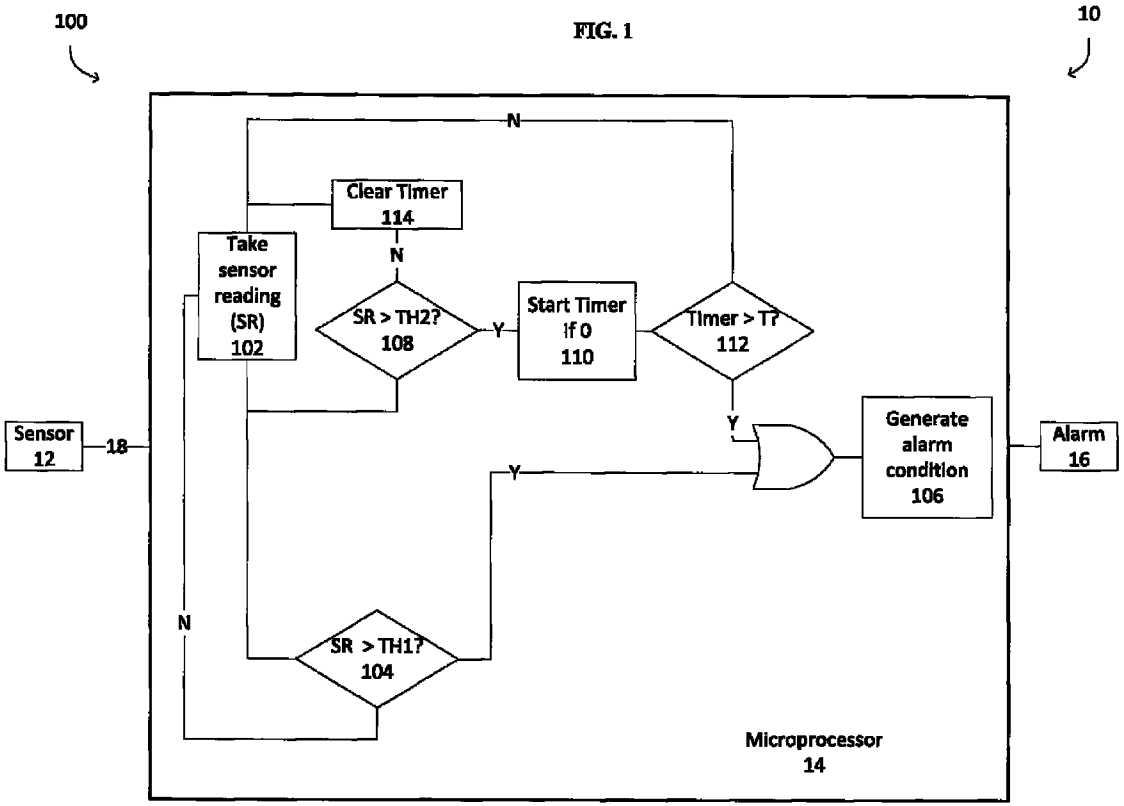
FIG. 1 is a diagram of the present Smoke Detector which includes the logic of a signal processor illustrating a first embodiment of the present Smoke detector which uses the Two Threshold Algorithm.
Figure 6:
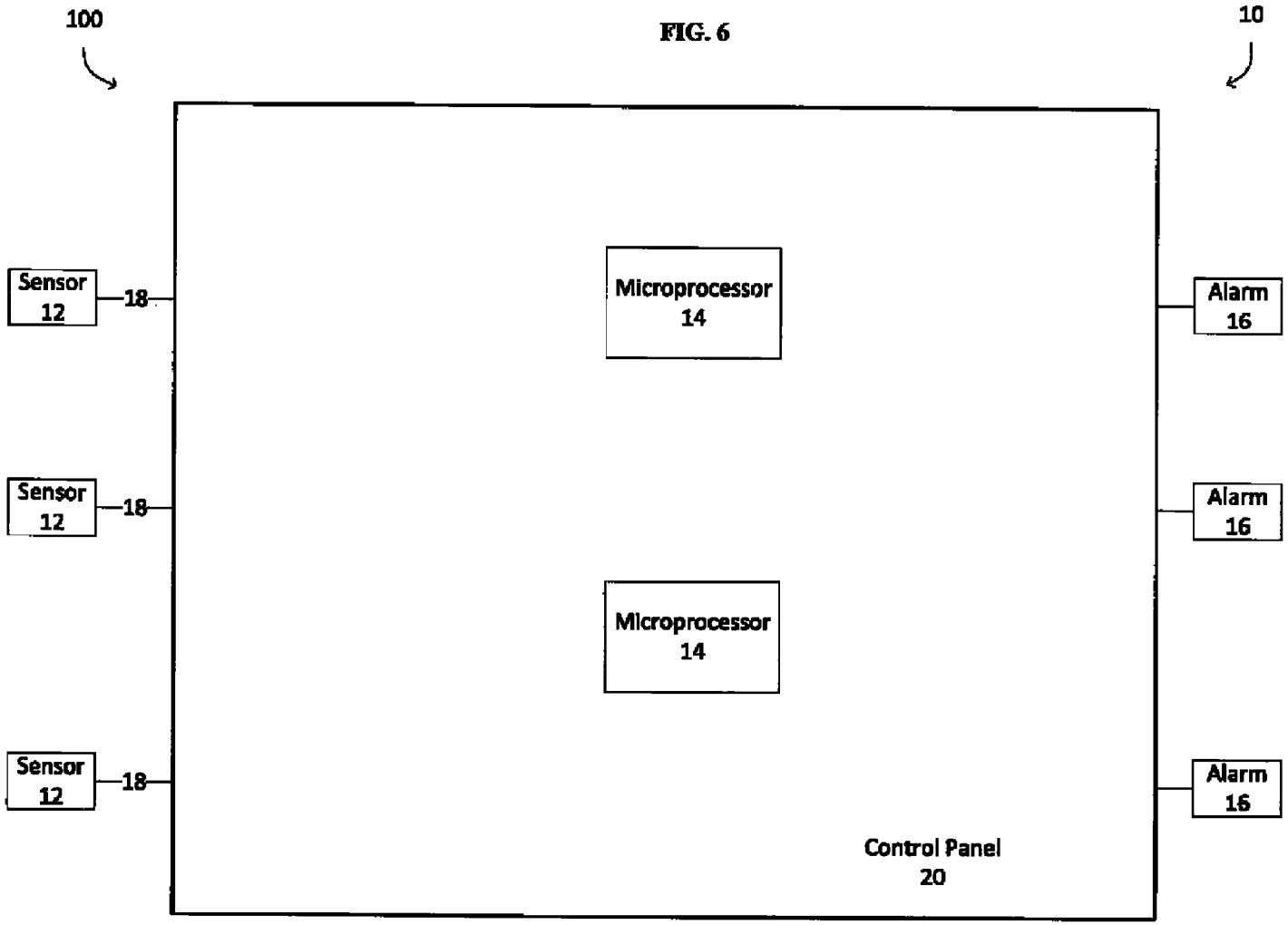
FIG. 6 is a diagram of the present Smoke Detector connected to a control panel.

As shown in FIGS. 1 and 6, a smoke detector is generally designated as 10 and includes a sensor 12 connected to a microprocessor 14 and an alarm 16. The sensor 12 is contemplated as being capable of producing a signal proportional to the amount of smoke in the environment, and more specifically is either an ionization smoke sensor or a photoelectric smoke sensor, with the former being preferred. Both sensor types are well known and it is preferred that a single sensor 12 is used. Alternative types of the sensor 12 may be used, including sensors for detecting carbon dioxide ($CO_2$) and carbon monoxide (CO).

The microprocessor 14 may be any processing device capable of processing an output signal 18 generated by the sensor 12 and implementing the algorithms or logic described herein. Although it is preferred that a single processor 14 be used, use of multiple processors is contemplated. In addition, the microprocessor 14 may be used in conjunction with optional external memory. It should also be appreciated that the output signal 18 generally refers to the output voltage or current of the sensor 12. Each of the threshold values described subsequently are determined based on the type of sensor 12 used and corresponding voltage, current or resistance signals generated by the sensor.

In addition, the sensor output signal 18 may be filtered in one or multiple ways to remove signal noise using techniques such as an average, weighted-average or moving-average. Such techniques are well known in the art, for example in U.S. Pat. No. 5,736,928, incorporated by reference, and may vary based on the level of filtering or smoothing desired by each branch of the algorithm. As should be appreciated, the filtering technique chosen should be compatible with the microprocessor 14 and corresponding amount of memory. Furthermore, it is contemplated that multiple detectors 10, each provided with the sensor 12 with or without the alarm 16 may be connected to a central control panel 20 (FIG. 6) where the algorithms are processed. The central control panel 20 may include one or more processors 14 and may also perform additional processing functions such as filtering, threshold adjustment or drift adjustment (which are described subsequently). In addition, the central control panel 20 may also include one or more alarms 16.

Referring now to FIGS. 1, 2, 4 and 5, in each embodiment of smoke detector, respectively generally designated as 100, 200, 300, 400, the sensor 12 determines the level of smoke in the air and generates the corresponding output signal 18. It will be appreciated that FIG. 1 schematically depicts the smoke detector 10, while FIGS. 2-5 depict alternative logic structures for the microprocessor 14, with the remainder of the components of FIG. 1 being the same. The output signal 18 is used as the input for a first algorithm for detecting a fast flaming fire and a second algorithm for detecting smoldering fires. The alarm 16 is sounded or visually displayed when either algorithm generates an alarm condition. The first or fast flaming detection algorithm (hereinafter the "Fast Flaming Algorithm") is known in the art and is substantially the same for all embodiments. Four variations of the second algorithm are described herein and are respectively referred to as the: (1) "Two Threshold Algorithm"; (2) "Rate of Change (ROC) Algorithm"; (3) "Delta Algorithm"; and (4) "Standard Deviation (STDEV) Algorithm" (collectively the "Smoldering Fire Algorithms"). As should be appreciated, the algorithms described herein may be implemented using various combinations of logic gates or other logical functions and are not limited to the specific implementations described or illustrated. In addition, the first and second algorithms may be processed concurrently or sequentially in any order depending on the microprocessor used. The Standard Deviation algorithm can be used in conjunction with the other three algorithms as a second check to further insure positive detection.

Referring again to FIGS. 1, 2, 4 and 5, in these four, the first algorithm or Fast Flaming Algorithm includes a first threshold (TH1) for detecting a fast flaming fire. As illustrated, the sensor 12 continually takes readings of the environment 102, 202, 302, 402 and produces the output signal 18 proportional to the amount of smoke present in the environment. The output signal 18 is then compared by the microprocessor 14 to a preset first threshold value 104, 204, 304, 404. If the sensed output signal 18 exceeds the first threshold, an alarm condition 106, 206, 306, 406 is generated, and the alarm 16 is activated, visually and/or audibly. Importantly, the output signal 18 needs to exceed the first threshold 104, 204, 304, 404 only a single time or after only a single environmental reading before an alarm condition is generated 106, 206, 306, 406. As such, detection of fast flaming fires is virtually instantaneous upon reaching the first threshold level. However, the Fast Flaming Algorithm may alternately be configured for generating an alarm condition after the output signal 18 exceeds the first threshold 104, 204, 304, 404 for T, a short amount of time, or it may reset requiring a next output signal (s) 18 to also exceed the first threshold 104. If the output signal 18 does not exceed the first threshold 104, 204, 304, 404, the sensor 12 continues taking readings 102, 202, 302, 402 until the alarm condition is met.

Preferably, the initial value for the first threshold is factory set between 1% and 4% obscuration and is configured for triggering an alarm condition 106, 206, 306, 406 when the prescribed factory setting of smoke in the air, THL1, is met. However, the concentration value for the first threshold may vary within the range based on detector design, application and desired level of sensitivity and false alarm immunity. Further, the first threshold is optionally dynamically adjusted to compensate for changing environment conditions due to dust, dirt films, deterioration of components, etc. This is also known as "drift adjustment" and is described in U.S. Pat. No.

5,764,142 which is incorporated by reference. In addition, the Algorithm also optionally generates a trouble warning when small signal level changes become continuous due to dust, dirt films and/or deterioration of components, etc. Such trouble warnings are known in the art and typically cause a trouble light to illuminate and/or an audible trouble signal.

Turning now to FIG. 1, the first embodiment 100 uses the Two Threshold Algorithm as the second or smoldering fire detection algorithm. In this embodiment 100, the alarm 16 is sounded when either the Fast Flaming Algorithm or the Two Threshold Algorithm generates the alarm condition 106. The Two Threshold Algorithm generates an alarm condition 106 when the output signal 18 continually exceeds a second threshold (TH2) 108 for T amount of time 112 or N readings. The value of T may vary and is generally in the range of 1 to 15 minutes. Preferably, the time T is long enough so that between 8-30 sensor readings 102 are taken and compared to the second threshold 108. However, the length of time or number of readings 102 can vary based on preference and desired level of sensitivity and false alarm immunity.

During operation of this embodiment 100, a timer is started 110 or sensor signal readings are counted when the sensor output signal 18 initially exceeds the second threshold 108. In subsequent consecutive readings where the sensor output signal 18 exceeds the second threshold 108, a comparison is made to determine if the second threshold has been exceeded for T time or N readings 112. If the second threshold is exceeded for T time 112 or N readings, the alarm condition 106 is generated. If the second threshold is not exceeded for T time 112 or N readings, additional readings are taken 102 until T time or N readings. At that point, if the output signal has constantly been greater than the second threshold 112, the alarm condition 106 is generated. If after any reading 102 the output signal 18 does not exceed the second threshold 108, the timer or counter is reset to zero 114 and additional readings are taken. The timer or counter is not started again 110 until the sensor output signal 18 exceeds the second threshold 108. Unlike the Fast Flaming Algorithm, where an alarm condition is generated the first instant the sensor output signal 18 exceeds the first threshold 104, in the Two Threshold Algorithm used for detecting smoldering fires, the sensor output signal 18 should exceed the second threshold 108 for T amount of time 112 or N readings before an alarm condition 106 is generated.

In the preferred configuration, the second threshold is factory set between 0.3%-1% obscuration and will trigger the alarm condition 106 when the air continuously has a corresponding or greater concentration of smoke. Since the sensor output signal 18 should exceed the second threshold 108 for T amount of time 112 or N readings before an alarm condition 106 is generated, the second threshold concentration level is lower (more sensitive) than the first threshold concentration level. This distinction facilitates detection of smoldering fires which initially have a lower concentration of smoke in the air during the early stages of the fires growth.

Values for the second threshold can vary based on application and may be constant or dynamically adjusted based on changing environment conditions. Dynamic adjustment to increase sensitivity and to compensate for fluctuations in the signal readings is achieved by calculating the standard deviation of signal fluctuations using historical readings 102 for an extended time period, then modifying the second threshold by a percent of the difference between the current standard deviation compared to the prior standard deviation. In one embodiment, the second threshold is adjusted based on a difference in the last two standard deviations of signal fluctuations. Furthermore, it is also contemplated that the second threshold is decreased if the standard deviation in the output signal is less than 0.05% obscuration and increasing the second threshold if the standard deviation in the output signal is between 0.1% and 0.2%.

Accuracy of the standard deviation will increase over a longer period of time. If the fluctuations are large, the second threshold is set less sensitive. If the fluctuations are small, the second threshold is set more sensitive. Furthermore, the second threshold can also be adjusted for drift using the same techniques explained previously for the Fast Flaming Algorithm. Importantly, the second threshold must be set beyond the anticipated amount of drift compensation.

Figure 2:
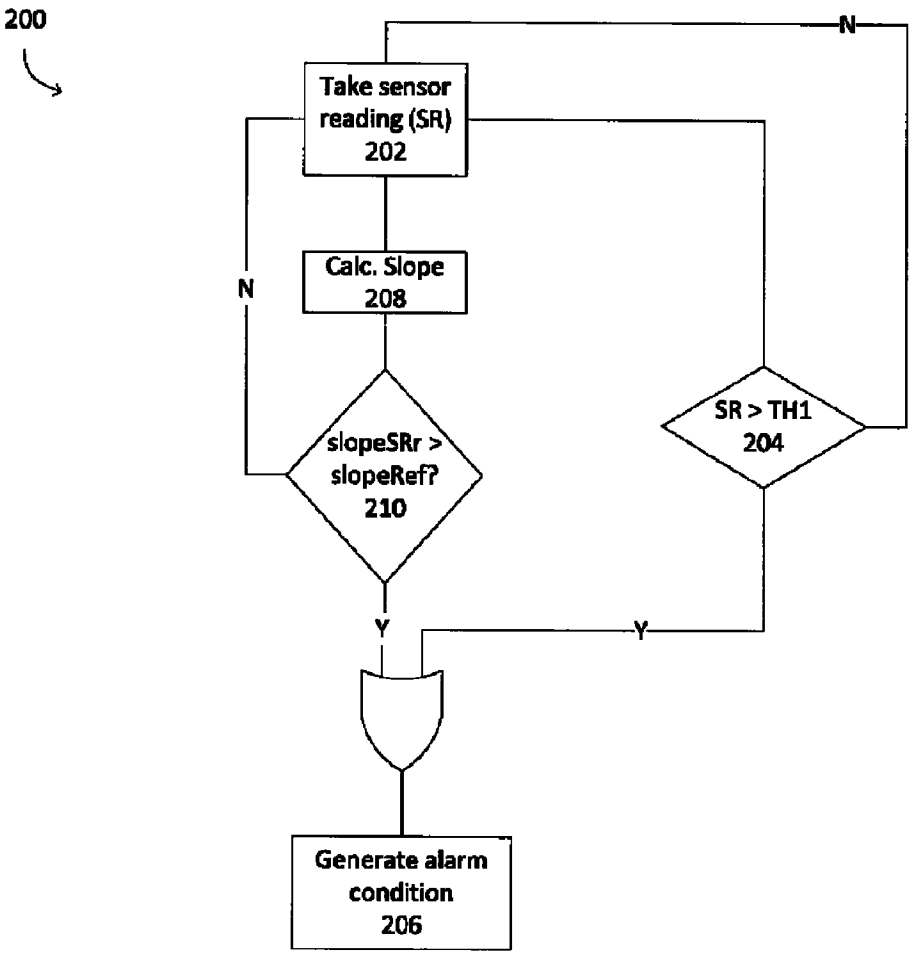
FIG. 2 is a flow diagram implementing the logic of a signal processor illustrating a second embodiment of the present Smoke Detector which uses the Rate of Change Algorithm.
Figure 3:
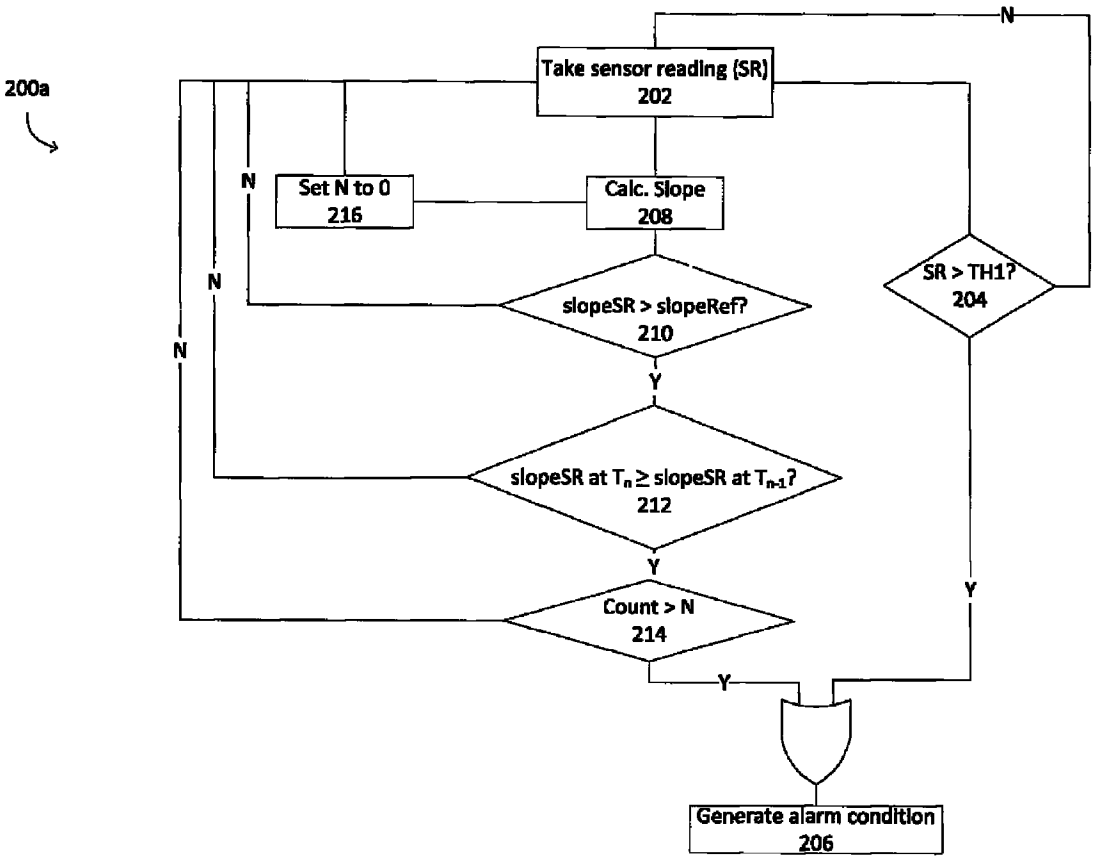
FIG. 3 is a flow diagram implementing the logic of a signal processor illustrating the second embodiment of the present Smoke Detector which uses the Rate of Change Algorithm with additional features.

Moving now to FIG. 2, the logic of the microprocessor 14 is depicted which has been substituted for that of FIG. 1. The second embodiment 200 uses the Rate of Change (ROC) Algorithm to detect smoldering fires. In this embodiment, the alarm 16 is activated when the Fast Flaming Algorithm or ROC Algorithm generates an alarm condition 206. The ROC Algorithm alarm condition is satisfied when the output signal 18 rate of change or slope (slopeSR) is greater than a predetermined slope threshold (SlopeRef) over T time or N readings. In the embodiment 200, the sensor reading is taken 202 and the output signal 18 rate of change is calculated 208. If the rate of change exceeds the predetermined slope threshold 210, over T time or for N readings, an alarm condition is generated 206. If the rate of change does not exceed the predetermined slope threshold 210, additional readings are taken 202 until the alarm condition 206 is satisfied. The amount of time that the slope 208 has to exceed the predetermined slope may vary, but is preferably in the range of 2 to 15 minutes or long enough for approximately 8-30 sensor readings to take place. The threshold value is selectable based on the desired alarm sensitivity and false alarm immunity levels In an alternate configuration generally designated **200*a* and illustrated in FIG. 3, the ROC Algorithm generates an alarm condition 206 when the rate of change exceeds the predetermined threshold 210 for N readings and when the value of the sensor reading SR at $T_n$ is greater than said signal level at time at $T_{n-1}$ for N readings. This additional condition 212 and the corresponding values for N is customizable based on the desired alarm sensitivity and false alarm immunity levels. If at any time the slope does not exceed the predetermined level 210 or each subsequent reading is not closer to alarm 212, then N is set to zero 216 and additional readings are taken 202. In the preferred embodiment, the slope of percent obscuration over time threshold is factory set between 0.007%/min.-0.2%/min. and is configured to trigger the alarm condition 206** when the air has a corresponding or greater concentration of smoke. Values for the slope threshold can vary based on application.

Figure 4:
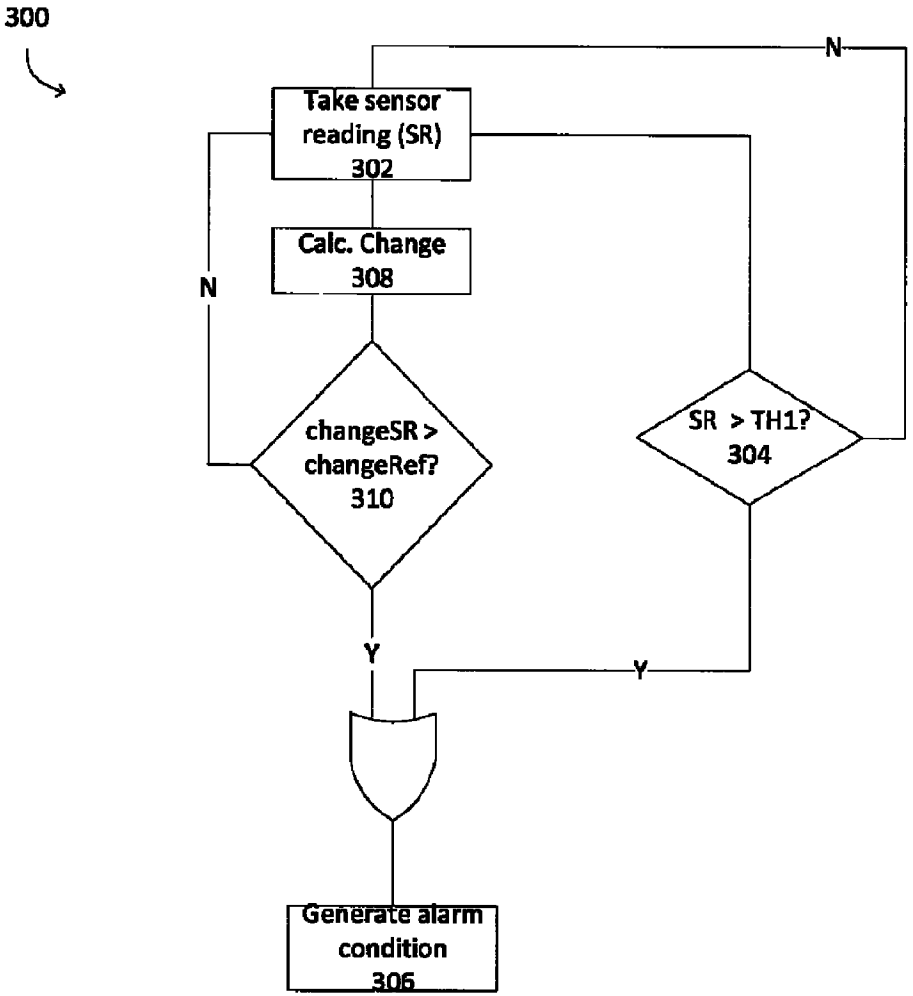
FIG. 4 is a flow diagram implementing the logic of a signal processor illustrating a third embodiment of the present Smoke Detector which uses the Delta Algorithm.

Referring now to FIG. 4, the logic of the microprocessor 14 is modified to the third embodiment 300 which utilizes the Delta Algorithm. In this embodiment, the alarm 16 is sounded when the Fast Flaming Algorithm or Delta Algorithm generates an alarm condition. The Delta Algorithm 306 alarm condition is met when the sensor signal changes relatively quickly (over minutes) compared to recent historic signal levels (averaged over hours or days) by an amount Delta. In other words, an alarm condition 306 is generated when the difference between one or more averaged output signal reading(s) and an average of historical signal readings is greater than a predetermined Delta Threshold 310 for N readings or T time. In this embodiment 300, the reading is taken 302 and the change, Delta, of the sensor signal 18 is calculated 308. If the Delta exceeds the predetermined Delta Threshold 310 for T time or N consecutive readings, the alarm condition 306 is generated. If the Delta does not exceed the predetermined Delta threshold 310, additional readings are taken 302. The amount of time between readings may vary, but T is preferably under 15 minutes and long enough for approximately 8-30 or more readings to take place.

In the preferred embodiment, the Delta Threshold is factory set between 0.3% -1.0% obscuration and is configured for triggering the alarm condition 306 when the air has a corresponding or greater concentration of smoke. Values for the Delta Threshold and the number of readings N or time T can vary based on application and may be constant or dynamically adjusted based on changing conditions. Dynamic adjustment of the Delta Threshold is achieved by calculating the standard deviation of the signal's fluctuations over time, calculating a next standard deviation over a similar time period, and then modifying the Delta Threshold by a percentage of the difference between the last two standard deviations. As such, the Algorithm is more sensitive when the fluctuations are getting smaller and less sensitive when the fluctuations are getting larger. As should be appreciated, the accuracy of the standard deviation will increase over a longer period of time.

Figure 5:
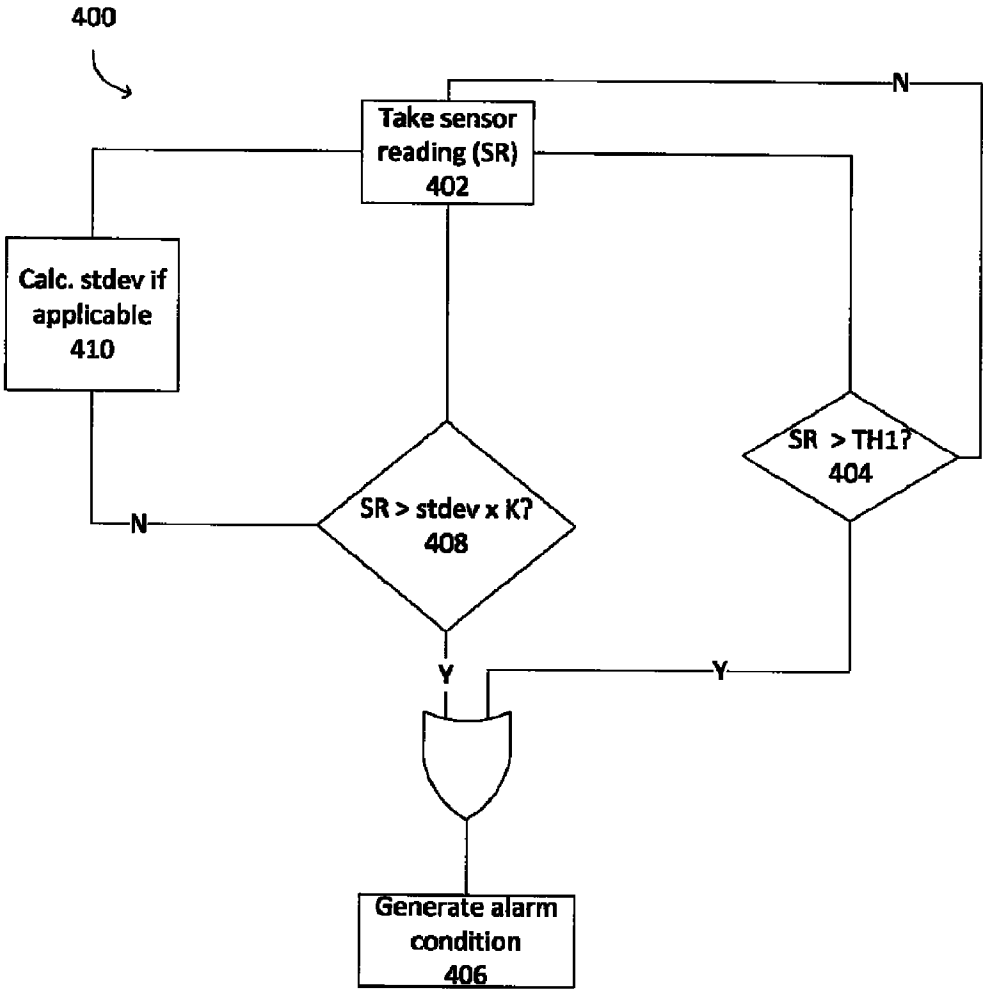
FIG. 5 is a flow diagram implementing the logic of a signal processor illustrating a fourth embodiment of the present Smoke Detector which uses the Standard Deviation Algorithm.

Moving now to FIG. 5, the logic of the microprocessor 14 is modified to the fourth embodiment 400, which sounds the alarm 16 when either the Fast Flaming Algorithm or Standard Deviation (STDEV) Algorithm generates the alarm condition 406. The STDEV Algorithm alarm condition 406 is satisfied when the sensor output signal exceeds a latest standard deviation of signal fluctuation multiplied by a constant K. In this embodiment, multiple readings are taken 402 and an initial standard deviation of the output signal 18 is calculated and stored. In the preferred embodiment, the initial standard deviation is set after a substantial number of readings have been taken so an accurate initial standard deviation can be achieved. Typically, it will take 24 hours for an accurate initial standard deviation to be established. However, the initial standard deviation threshold may also be factory set. As should be appreciated, the accuracy of the standard deviation will increase over a longer period of time.

Once the initial standard deviation is calculated, the standard deviation is periodically recalculated using newer sensor readings 410 with the amount of time between calculations preferably being at least 24 hours, and with the prior standard deviation being replaced. Sensor readings are taken 402 and an alarm condition is generated if the sensor output signal 18 exceeds the standard deviation multiplied by the constant K 408. If the current signal level 18 does not exceed the standard deviation multiplied by constant K 410, additional readings are taken 402 until an alarm condition is generated 406. In an alternate configuration, a plurality of readings may be taken 402 and the average of those readings is compared to the standard deviation multiplied by the constant K 408.

The value of the constant K may vary and should be chosen to optimize the sensitivity versus the false alarm immunity. For example, if the Standard Deviation is calculated to be the equivalent of 0.1% smoke and if K=1 using the normal distribution, there is a 30.8% chance that a false alarm could occur due to signal fluctuations. However, setting K at a high level will result in fewer false alarms. For example, if K=5 using the normal distribution, there is a 0.0001% probability of having a false alarm due to signal fluctuations. As indicated, the value for K is adjustable based on preference and desired sensitivity level and false alarm immunity. Values for K can vary based on application and may be constant or dynamically adjusted based on changing environment conditions. Dynamic adjustment is achieved by setting K as a function of the fluctuations in the signal—the smaller the fluctuations, the smaller the K. If fluctuations are large, K must also be large to reduce false alarms.

The STDEV Algorithm generates an alarm condition 406 after the first instance that the current signal level exceeds the standard deviation 410 multiplied by K. Furthermore, the STDEV Algorithm can also be configured to generate the alarm condition 410 only after the current signal level has exceeded the standard deviation multiplied by K for N number of samples or T time. The selection of K for generating the alarm condition 406 and the corresponding values for T and N are customizable based on the desired alarm sensitivity level and false alarm immunity.

It is preferred that the Fast Flaming Algorithm be combined with one of the Smoldering Fire Algorithms to detect both fast flaming fires and smoldering fires using a single sensor 12. However, it is also contemplated that one or more of the Smoldering Fire Algorithms may be used together in conjunction with the Fast Flaming Algorithm. Specifically, it is contemplated that the STDEV Algorithm may be used in conjunction with one or more of the other Smoldering Fire Algorithms. Furthermore, it is also contemplated that one or more of the Smoldering Fire Algorithms may be used to detect both fast flaming fires and smoldering fires. In addition, to facilitate better decisions in any of these algorithms, the sensor readings may be averaged or filtered specifically for each algorithm.

While a particular embodiment of the present apparatus and method for detecting fires has been shown and described, it will be appreciated by those skilled in the art that changes and modifications may be made thereto without departing from the invention in its broader aspects and as set forth in the following claims.

What is claimed:

1. A method of detecting smoldering type and flaming type fires using a smoke detector having a signal processor and a single sensor, comprising:

A. obtaining a single output signal reading from the sensor;

B. comparing said output signal reading to a first threshold;

C. comparing said output signal reading to a second threshold;

D. calculating a standard deviation;

E. generating an alarm condition for a flaming type fire only when said output signal reading is greater than said first threshold, and generating said alarm condition for a smoldering type fire only when said output signal reading exceeds a standard deviation of said output signal multiplied by a numerical constant; and F. repeating steps A through E until said alarm condition is generated.

2. The method of claim 1 wherein said sensor is a photoelectric sensor.

3. The method of claim 1 wherein said sensor is an ionization sensor.

4. A method of detecting smoldering type and flaming type fires using a smoke detector having a signal processor and a single sensor, comprising:

A. obtaining an output signal reading from the sensor;

B. comparing said output signal reading to a first threshold;

C. comparing said output signal reading to a second threshold;

D. adjusting said thresholds based on a difference in a standard deviation of said output signal's fluctuations;

E. generating an alarm condition for a flaming type fire only when said output signal reading is greater than said first threshold, and generating said alarm condition for a smoldering type fire only when said output signal reading is greater than said second threshold for N readings; and F. repeating steps A through E until said alarm condition is generated.

5. The method of claim 4 further comprising generating an alarm condition for a smoldering type fire when said output signal reading is greater than said second threshold for T time.

6. The method of claim 4 further comprising adjusting said first threshold and said second threshold for drift.

7. The method of claim 4 further comprising decreasing said second threshold if the standard deviation in said output signal is less than 0.05% obscuration.

8. The method of claim 4 further comprising increasing said second threshold if the standard deviation in said output signal is between 0.1% and 0.2% obscuration.

9. The method of claim 4 wherein said output signal reading is filtered.

10. The method of claim 4 further comprising calculating an average after a plurality of readings and generating said alarm condition for a smoldering type fire only when the difference between one or more averaged output signal readings and an average of historical signal readings is greater than a standard deviation multiplied by a numerical constant.

11. A smoke detector for detecting smoldering and fast-flaming fires, comprising:

a single sensor connected to a signal processor; and an alarm;

said signal processor configured for:

A. obtaining a sensor output signal reading from the sensor;

B. comparing said sensor output signal reading to a first threshold and generating an alarm condition for a fast flaming fire only when said sensor output signal reading is greater than said first threshold;

C. comparing said sensor output signal reading to a second threshold and generating said alarm condition for a smoldering fire when said sensor output signal reading is greater than said second threshold for T time;

D. adjusting said thresholds based on a difference in standard deviations of said output signal's fluctuations; and E. repeating steps A through D until said alarm condition is generated and sending an alarm signal to said alarm when said alarm condition is generated.

12. A smoke detector system, comprising:

a plurality sensors, each connected to a control panel including a signal processor and configured for detecting smoldering and fast-flaming fires;

at least one alarm connected to said central control panel; and said signal processor configured for:

A. obtaining a sensor output signal reading from the sensor;

B. comparing said sensor output signal reading to a first threshold and generating an alarm condition for a fast flaming fire only when said sensor output signal reading is greater than said first threshold;

C. comparing said sensor output signal reading to a second threshold and generating said alarm condition for a smoldering fire when said sensor output signal reading is greater than said second threshold for N readings;

D. adjusting said thresholds based on a difference in standard deviations of said output signal fluctuations; and E. repeating steps A through D until said alarm condition is generated and sending an alarm signal to said alarm when said alarm condition is generated.

13. The smoke detector system of claim 12 further comprising comparing said sensor output signal reading to a second threshold and generating said alarm condition for a smoldering type fire when said sensor output signal reading is greater than said second threshold for T time.

* * * * *